US005941463A

United States Patent [19]

Herstek et al.

[11] Patent Number: 5,941,463

[45] Date of Patent: Aug. 24, 1999

[54] SPRAY GUN WITH ROTATABLY ADJUSTABLE NOZZLE

[75] Inventors: Glen Herstek, Elyria; Joseph C. Waryu, Amherst; Thomas A. Loparo, Elyria, all of Ohio

[73] Assignee: Nordson Coporation, Westlake, Ohio

[21] Appl. No.: 08/938,811

[22] Filed: Mar. 21, 1997

[51] Int. Cl.[6] ..... B05B 15/08

[52] U.S. Cl. ..... 239/587.1; 239/394

[58] Field of Search ..... 239/587.1, 597, 239/599, 394, 299

[56] References Cited

U.S. PATENT DOCUMENTS

| | | | |
|---|---|---|---|
| 1,276,245 | 8/1918 | Milliard et al. | 239/597 |
| 2,125,445 | 2/1938 | Holveck | 239/599 |
| 2,172,193 | 9/1939 | Downs | 239/140 |
| 2,755,137 | 7/1956 | Hughf | 239/597 |
| 3,416,736 | 12/1968 | Marik | 239/597 |
| 3,602,433 | 8/1971 | Proctor . | |
| 3,630,453 | 12/1971 | Lane et al. | 239/437 |
| 4,494,699 | 1/1985 | Hengesbach | 239/499 |
| 4,533,005 | 8/1985 | Morris . | |
| 5,052,624 | 10/1991 | Boers et al. | 239/525 |
| 5,316,219 | 5/1994 | Christyson et al. | 239/533.1 |
| 5,642,860 | 7/1997 | Bush et al. | 239/333 |

FOREIGN PATENT DOCUMENTS

| | | |
|---|---|---|
| 0 430 858 A2 | 6/1991 | European Pat. Off. . |
| 1 014 618 | 4/1983 | U.S.S.R. . |
| PCT/WO 97/02896 | 1/1997 | WIPO . |

*Primary Examiner*—Andres Kashnikow
*Assistant Examiner*—David Deal
*Attorney, Agent, or Firm*—Rankin, Hill, Porter & Clark LLP

[57] ABSTRACT

A spray gun for spraying a fluid has a manifold for connection to a supply of fluid, and a nozzle assembly is attached to the manifold. The nozzle assembly has a spray nozzle producing a generally fan-shaped spray pattern lying generally in a plane. The nozzle assembly is rotatable relative to manifold to permit the plane of the spray pattern to be manually reoriented while maintaining the manifold in a fixed position. The spray gun can be activated to produce the directional spray pattern. The nozzle assembly is manually rotated relative to the manifold while the spray gun is activated, and the spray pattern is observed the spray pattern while rotating the nozzle assembly. The rotatable nozzle assembly permits the plane of the spray pattern to be adjusted without turning the spray gun off.

20 Claims, 3 Drawing Sheets

SPRAY GUN WITH ROTATABLY ADJUSTABLE NOZZLE

BACKGROUND OF THE INVENTION

1. Field of the Invention

This invention relates to spraying dispensers or spray guns, and more particularly to spray guns which produce a generally flat, fan-shaped spray pattern and which require adjustment to orient the spray pattern in the proper plane.

2. Description of the Prior Art

Coating processes are often accomplished using spray guns which spray a fluid coating material onto articles. These spray guns can incorporate a specially designed nozzle which provides a spray pattern adapted for the particular application. In certain coating operations, the spray patten produced by the nozzle is essentially a flat triangular pattern, in which the spray flairs outwardly in one direction and in which the spray pattern is relatively flat in the orthogonal direction, creating what is generally a two-dimensional fan-shaped spray pattern. A spray pattern such as this is useful in coating many various types of objects. For example, in the spray coating of the inside of cans, a spray gun producing this flat spray pattern is used, and the can is rotated in front of the gun to provide a smooth, even coating inside the can.

Since the spray pattern is generally two dimensional, it is important that the spray nozzle be properly adjusted so that the spray pattern is projected in the proper plane. The adjustment of the nozzle has heretofore been a tedious undertaking, requiring the operator to observe the spray pattern, turn the spray gun off, loosen the nozzle on the spray gun, attempt to adjust the orientation of the nozzle according to the spray pattern previously observed, re-secure the nozzle to the spray gun, turn the gun back on, and observe the new spray pattern. This procedure is often repeated several times before the orientation of the gun is acceptable. The spray pattern must be reset whenever different sized containers are being sprayed, and the spray pattern must be re-adjusted periodically due to wear of the nozzle and changes in the material. Furthermore, if any changes are made in the spraying process, such as removal of the gun for cleaning or maintenance, this procedure must be repeated before production can be resumed. As a result, a considerable amount of spraying processing time is wasted during adjustment of the orientation of the spray pattern.

SUMMARY OF THE INVENTION

The present invention provides a unique mounting arrangement for a fluid spray gun which allows the nozzle to be adjusted by rotating the spray gun. Using the present invention, it is not necessary to turn the gun off during adjustment of the spray pattern. As a result, the spray pattern produced by the spray gun can be observed throughout the adjustment process, and the adjustment can be accomplished much more rapidly.

In the spray gun of the present invention, the nozzle assembly is rotatable relative to the remainder of the spray gun, so that the orientation of the spray pattern produced by the nozzle assembly can be easily changed without stopping the spraying operation. Once nozzle is in the proper orientation, the nozzle assembly can be secured in position, so that the desired spray pattern can be preserved.

Using the spray gun of the present invention, the operator can loosen the nozzle assembly from its position, rotate the nozzle assembly until the spray pattern is in the desired plane, and re-secure the nozzle assembly, all without turning the spray gun off, and the orientation of the spray pattern can be accomplished in far less time than has been possible heretofore. Since the spray pattern must be adjusted due to changing container sizes or nozzle wear and must be set whenever the gun is removed for cleaning or maintenance, the spray pattern can be properly set in less time resulting in more efficient operation of the spray coating apparatus.

These and other advantages are provided by the present invention of a spray gun for spraying a fluid which comprises a manifold and a nozzle assembly. The manifold is for connection to a supply of fluid. The nozzle assembly is attached to the manifold. The nozzle assembly has a spray nozzle producing a generally fan-shaped spray pattern lying generally in a plane. The nozzle assembly is rotatable relative to manifold to permit the plane of the spray pattern to be manually reoriented while maintaining the manifold in a fixed position.

In accordance with another aspect of the present invention, the invention comprises a method of adjusting a fluid spray pattern produced by a spray gun having a nozzle which produces a generally flat directional spray pattern. The method comprises the steps of providing a nozzle assembly having the nozzle fixed therein and having a valving mechanism to control the flow of fluid, mounting the spray gun with the nozzle assembly in a body which permits the nozzle assembly to be manually rotatably adjusted, activating the spray gun to produce the directional spray pattern, manually rotating the nozzle assembly relative to the body while the spray gun is activated, observing the spray pattern while rotating the nozzle assembly, and stopping rotating when the desired spray pattern is observed.

DETAILED DESCRIPTION OF THE PREFERRED EMBODIMENT

Figure 1:
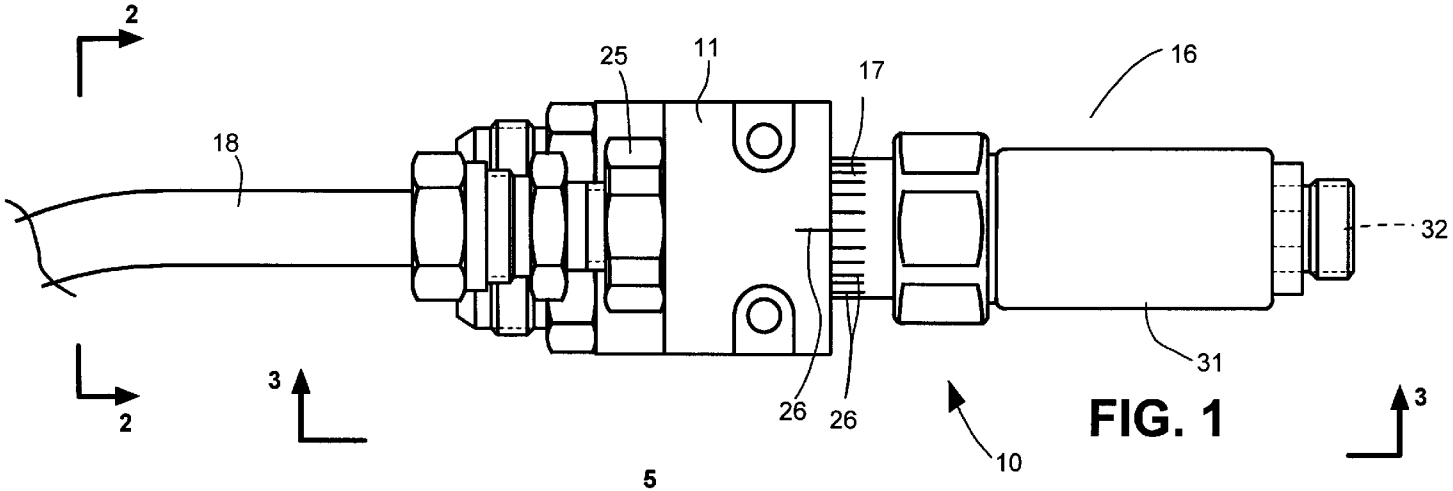
FIG. 1 is a plan view of the spray gun of the present invention.
Figure 2:
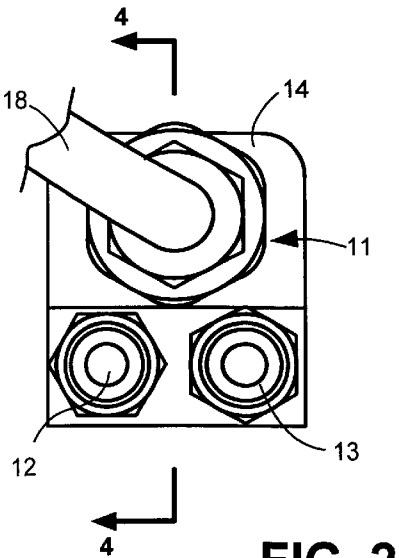
FIG. 2 is an end elevational view of the spray gun taken along line 2—2 of FIG. 1.

Referring more particularly to the drawings and initially to FIGS. 1 and 2, there is shown a spray gun 10 according to the present invention. The spray gun 10 includes a body forming a manifold 11 by which the gun may be connected to other elements of the spray coating system and by which the gun may be mounted to a support by appropriate mounting means (not shown). The manifold 11 includes a pair of hose connections 12 and 13 for connection of the gun to a supply of fluid to be sprayed. One of the connections 12 may be used to supply fluid to the gun, and the other connection 13 may be used to return fluid to the supply when the gun is not in operation, so that fluid is continually circulating. The body that forms the manifold 11 also includes a sleeve portion 14 having an enlarged circular bore 15 (FIGS. 4 and 5) within which an adjustable nozzle assembly 16 is mounted. The nozzle assembly 16 is generally cylindrical in shape and includes a rear member 17 having a fitting for connection to an electrical conduit 18.

Figure 3:
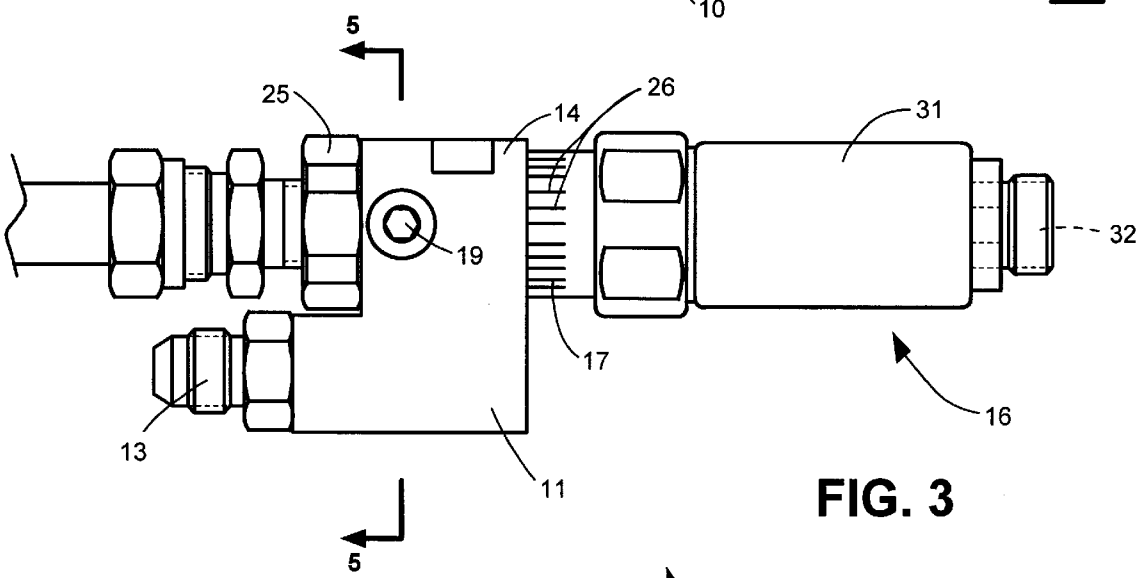
FIG. 3 is a side elevational view of the spray gun taken along line 3—3 of FIG. 1.
Figure 4:
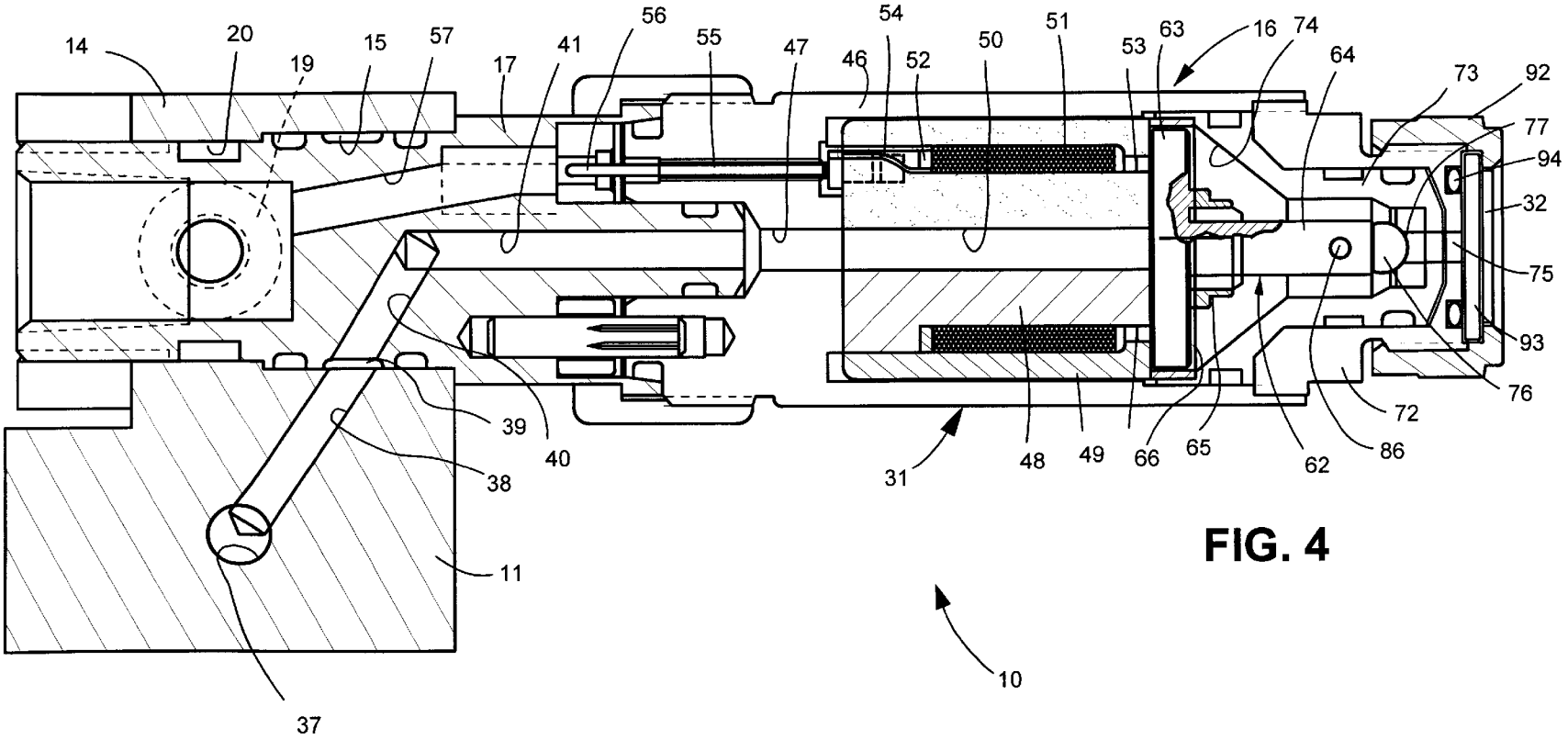
FIG. 4 is a cross sectional side view of the spray gun taken along line 4—4 of FIG. 2.
Figure 5:
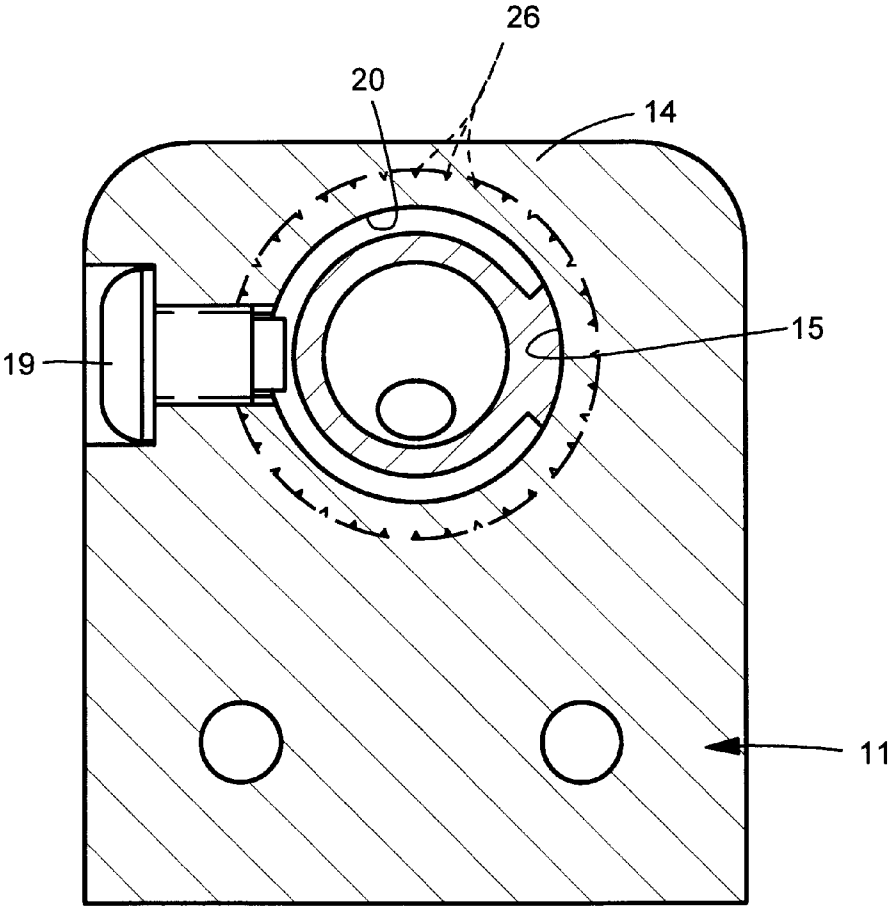
FIG. 5 is a cross sectional end view of a portion of the spray gun taken along line 5—5 of FIG. 3.

The rear member 17 is mounted within the circular bore 15 so as to be rotatable adjustable relative to the manifold 11. The rotation of the rear member 17 is limited by a stop screw 19 (FIGS. 3 and 5) which is mounted in the sleeve portion 14 of the manifold 11 and which extends into the bore 15. A circumferential groove 20 (FIGS. 4 and 5) is formed in the exterior surface of the member 17 at the location of the stop screw 19. The groove 20 does not extend completely around the rear member 17, but only extends approximately 270° around the exterior surface of the rear member as shown in FIG. 5.

A lock nut 25 (FIGS. 1 and 3) is threadedly mounted on member 17 adjacent to the sleeve portion 14 of the manifold 11. When the lock nut 25 is tightened, it secures the sleeve 14 to the member 17 and thus locks the position of the nozzle assembly 16 relative to the manifold. When the lock nut 25 is loosened, the member 17 is free to rotate within the bore 15, and thus the nozzle assembly 16 may be rotated within sleeve of the manifold 11. Indicia 26 (FIGS. 1 and 3) in the form of a plurality of parallel lines is preferably provided on the exterior of the member 17 adjacent to the sleeve and a single line positioned on the adjacent exterior surface of the sleeve 14, so that, as the nozzle assembly 16 is rotated, the amount of the rotation can be easily discerned.

Mounted to the forward end of the rear member 17 is an actuating module 31 having a nozzle 32 at its forward end. The module 31 contains a high-speed valve mechanism which regulates the flow of the fluid coating material through the nozzle. In accordance with conventional spraying techniques, the nozzle 32 is configured to produce a generally flat or fan-shaped spray pattern, as opposed to a conical spray pattern.

Fluid coating material from a supply source enters the gun 10 though a supply hose (not shown) connected to one of the hose connections 12 or 13 on the manifold 11. The other of the hose connections 12 or 13 is connected to a return hose (also not shown). Both connections the connections 12 and 13 are connected to a passageway 37 (FIG. 4) which extends across the manifold 11. The fluid enters the manifold 11 through one of the hose connections 12 or 13 and flows through the cross passageway 37. If the gun is not operating, the fluid then flows out of the manifold 11 through the return hose connection. If the gun is operating, the fluid flows from the cross passageway 37 through a diagonally extending passageway 38 which communicates with the cross passageway. The diagonally extending passageway 38 extends to the bore 15, where a circular groove 39 is formed on the exterior of the member 17. The circular groove 39 is sealed by a pair of O-rings 42 and 43 which are located in grooves in the member 17 on either side of the passageway groove 39. A diagonally extending passageway 40 in the member 17 communicates with the groove 39. The groove 39 thus connects the passageway 38 with the passageway 40 regardless of the orientation of the nozzle assembly 16 is within the bore 15. From the diagonally extending passageway 40, the fluid travels through an axially extending passageway 41 and into the actuating module 31.

The module 31 contains a high-speed valve mechanism which controls the spraying of the fluid coating material from the gun. The high-speed valve mechanism may be similar to that described in U.S. patent application Serial No. 08/630,677, the disclosure of which is hereby incorporated by reference in its entirety. With reference to FIG. 4, the module 31 includes an outer body 46 having a central passageway 47 which extends coaxially from the axial passageway 17 in the rear member 17. A magnetic core comprising an inner core 48 and an outer core 49 is mounted in the body 46. The generally cylindrical inner core 48 is mounted within a corresponding cylindrical bore in the module body 46. A central axial passageway 50 extends through the inner core 48 and is coaxial with the passageway 47 in the module body 46. A coil 51 is wound around the inner core 48 with annular spacers 52 and 53 on each end of the coil. The outer core 49 surrounds the inner core 48 and the coil 51. A pair of leads 54 extends from the rear end of the coil 51 and extend through an insulator tube 55 to an electrical connection 56 formed at the rear end of the module body 46. Electrical wires (not shown) are attached to the connection and extend through channels 57 in the member 17 and are connected to the conduit 18.

The forward end of the cores 48 and 49 have forward end faces which lie in the same horizontal plane, and an armature 62 having disc portion 63 is positioned against the forward end faces of the cores. The armature 62 also has a stem portion 64 which extends axially from the disc portion 63. The armature 62 is free to move a limited distance within the module body 46 toward and away from the cores 48 and 49. A bushing 65 is press fit around the exterior of the stem portion 64 were the stem portion extends from the disc portion 63 of the armature, and a diaphragm spring 66 is sandwiched between the armature 62 and the bushing 65.

A retainer 72 is threadedly attached to the forward end of the module body 46. A generally conical valve seat holder 73 is positioned within the retainer 72, and a generally conical chamber 74 is formed within the holder 73 in front of the cores 48 and 49. A dispensing cavity 75 extends through the holder 73 and the retainer 72 from the front of the chamber 74. Within the chamber 74 is a spherical valve member 76 which engages an annular valve seat 77 mounted in the holder 73 at the bottom of the chamber 74 to seal off the dispensing cavity 75. The valve member 76 and the valve seat 77 are preferably made of a hard durable material such as tungsten carbide. The hard material permits the valve to undergo multiple cycles with a minimal amount of wear to the valve member 76 and the valve seat 77.

The valve member 76 is connected to the stem portion 64 of the armature 62. The armature 62 has a central axial passageway which extends through the center of the stem portion 64 and which communicates at its rear end with the passageway 50 extending through the core and at its forward end with radial passageways 86 in the stem portion to allow the fluid coating material to enter the conical nozzle chamber 74. An annular spacer ring 87 is located between the armature 62 and the inside wall of the module body 46. The size of the spacer ring 87 in the axial direction controls the stroke of the armature 62. The armature 62 has a plurality of vent holes extending through the disc portion 63 in a direction parallel to the axis of the armature. A network of grooves can be provided on the rear surface of the disc portion 63 of the armature 62 to help channel fluid between the armature 62, and the core 48, 49 toward the vent holes in the armature so that the fluid can be pushed out from between the armature and the core when the annature is pulled toward the core.

The diaphragm spring 66 is used to bias the armature 62 toward the forward end or dispensing end and thus to bias the valve member 76 closed. The spring 66 is donut-shaped, and the inside diameter portion of the spring 66 is captured between the armature 62 and the bushing 65, while the outer edge of the spring is captured between the spacer ring 87 and the retainer 72. The spring 66 is preferably keyed against rotation relative to the module body 46 such as by forming a tab (not shown) on the outside periphery of the spring which projects into a slot (not shown) formed in the module body 46. The spring 66 can also include a second tab (not shown) on its inside diameter to project into a slot (not shown) formed in the armature 62. This keying of the spring 66 prevents the spherical valve member 76 from rotating with respect to the valve seat 77 so that the valve member 76 wears evenly with respect to the seat 77. The diaphragm spring 66 also has a plurality of vent holes which align with the axially extending vent holes in the armature 62. The previously described tab which can be formed on the inside diameter of the spring 66 to lock the spring against rotation with the armature 62 can also be used to maintain alignment between the holes of the spring and the holes of the inner armature.

A nozzle holder 92 is threadedly attached to the forward end of the retainer 72. A spray member or nozzle member 93 is captured between the retainer 72 and the nozzle holder 92 and covers the forward end of the dispensing cavity 75. An O-ring 94 is located within a corresponding groove in the forward end of the retainer 72 to seal the nozzle member 93 to the retainer. In accordance with known spraying techniques, the nozzle member 93 is formed so as to produce the desired spray pattern as the fluid coating material passes therethrough. This spray pattern is often a generally flat triangular pattern. In other words, the spray pattern is often two dimensional, such that the entire spray pattern is fan-shaped and fits generally in a plane. This plane is usually oriented such that the central axis of the nozzle member 93, which is also the central axis of the module 31, lies within this plane. The nozzle holder 92 is preferably threaded onto the retainer 72 is secured with finger tightness, so that the nozzle member 93 can be removed and replaced without the use of tools.

The valve mechanism contained in the module 31 is normally closed by action of the spring 66 urging the armature 62 forward, or to the right as shown in FIG. 4, so that the valve member 76 firmly engages the valve seat 77. When the coil 51 is energized, a magnetic field is established around the coil and a flux loop is created extending from the outer core 49 through the outer part of the disc portion 63 of the armature 62, through the inner core 48 and back to the outer core 49. The windings of the coil 51 along with the relatively large pole face area presented by the armature 62, opposite the end face area of the core combine to produce a relatively large electromagnetic force to pull the armature toward the core 48, 49 and allow the valve member 76 to move away from the valve seat 77 and open the valve. The fluid material that is temporarily captured between the armature 62, and the core 48, 49 is channeled by means of the groove network on the rear surface of the armature into the vent holes in the armature, so that it flows into the chamber 74 as the armature 62, moves upwardly. When the coil 51 is again de-energized, the diaphragm spring 66 pushes the armature 62, in the opposite direction to close the valve. As the valve closes, the space between the armature 62 and the core 48, 49 is quickly filled by the fluid which flows from the chamber 74 back through the vent holes to the space between the armature 62, and the core 48, 49.

In operation of the spray gun of the present invention, the operator positions the gun 10 in the approximate desired position, connecting the hose connections 12 and 13 to the supply of fluid and connecting the electrical conduit 18 to a suitable control system. With the spray gun pointed in the approximate desired direction, the operator turns the gun on, so that fluid sprays from the nozzle 32. As previously described the nozzle 32 produces a generally flat spray pattern, so that the spray pattern lies generally within a plane, and the orientation of this plane depends upon the rotation of the nozzle assembly 16. The operator then loosens the lock nut 25 to permit the nozzle assembly 16 to be rotated relative to the manifold 11, and the operator rotates the entire nozzle assembly until the spray pattern is in the desired plane. This adjustment is carried out while the spray gun is on, so that the operator can instantly see the results of rotating the nozzle assembly. As the operator rotates the nozzle assembly 16, the amount of rotation can be noted by the indicia 26 on the exterior of the nozzle assembly member 17. The nozzle assembly 16 can be rotated over a 270° range, but is prevented from further rotation by the engagement of the stop screw 19 within the groove 20, in order to prevent the electrical conduit 18 from becoming twisted. After the spray pattern is in the exactly correct orientation, the operator tightens the lock nut 25 to secure the nozzle assembly 16 to the manifold 11 in the desired position. Thereafter, if it becomes necessary to re-adjust the orientation of the spray pattern, this can be accomplished by loosening the lock nut 25, rotating the nozzle assembly 16 relative to the manifold 11, and re-tightening the lock nut, all without turning off the spray gun.

The nozzle is fixed with respect to the nozzle assembly 16, but, because of the rotatability of the nozzle assembly 16 relative to the manifold 11, the position of the nozzle can be easily adjusted simply by rotating the nozzle assembly within the sleeve of the manifold.

Although the invention has been shown with reference to a particular high-speed valving mechanism contained in the module, other valving mechanism can be used to control the spraying of the fluid coating material from the gun.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is inconsistent with the extent to which the progress in the art has been advanced by the invention.

What is claimed is:

1. A spray gun for spraying a fluid, which comprises:

a manifold for connection to a supply of fluid; and a nozzle assembly mounted to the manifold, the nozzle assembly including a valve mechanism therein to control the flow of the fluid to the spray nozzle, the nozzle assembly having a spray nozzle producing a substantially fan-shaped spray pattern lying generally in a plane, the nozzle assembly being rotatable relative to manifold to permit the plane of the spray pattern to be reoriented while maintaining the manifold in a fixed position.

2. A spray gun as defined in claim 1, wherein the manifold includes a body for mounting the spray gun to a support.

3. A spray gun as defined in claim 1, comprising in addition a locking device for selectively securing the nozzle assembly to the manifold in a fixed rotational position.

4. A spray gun as defined in claim 1, comprising in addition a stop device which limits the rotation of the nozzle assembly relative to the manifold.

5. A spray gun as defined in claim 4, wherein the stop device comprises a stop element on one of the manifold and the nozzle assembly, the stop element engaging a groove on the other of the manifold and the nozzle assembly.

6. A spray gun as defined in claim 1, comprising in addition indicia on the nozzle assembly to indicate the amount of rotation of the nozzle assembly relative to the manifold.

7. A spray gun as defined in claim 1, wherein the nozzle assembly is rotatable relative to the manifold while the fluid is being sprayed by the spray gun.

8. A spray gun as defined in claim 1, wherein the valve mechanism includes a valve member which controls the flow of fluid through the nozzle assembly and a valve actuator which operates the valve member.

9. A spray gun for spraying a fluid, which comprises:

a body for mounting the spray gun to a support, the body including a sleeve; and a nozzle assembly mounted in the sleeve, the nozzle assembly having a spray nozzle attached thereto, the spray nozzle producing a generally flat spray pattern, the nozzle assembly being manually angularly adjustable in the sleeve relative to the body to permit the spray pattern to be moved while maintaining the body in a fixed position.

10. A spray gun as defined in claim 9, wherein the body includes a connection for connecting the spray gun to a supply of the fluid.

11. A spray gun as defined in claim 9, wherein the nozzle assembly includes a valve mechanism to control the flow of the fluid to the spray nozzle.

12. A spray gun as defined in claim 9, comprising in addition a locking device for selectively securing the nozzle assembly to the body in a fixed angular position.

13. A spray gun for spraying a fluid, which comprises:

a body for mounting the spray gun to a support, the body including a sleeve and a connection for connecting the gun to a supply of fluid; and a nozzle assembly mounted for selective rotation in the sleeve, the nozzle assembly having a nozzle fixedly attached thereto, the nozzle assembly having a valving mechanism to control the flow of fluid to the nozzle, the nozzle producing a generally two-dimensional spray pattern in a plane, the nozzle assembly being manually angularly adjustable relative to the body to permit the plane of the spray pattern to be changed.

14. A spray gun as defined in claim 13, comprising in addition a locking device for selectively securing the rotational position of the nozzle assembly relative to the body.

15. A spray gun as defined in claim 13, comprising in addition a stop device which limits the rotation of the nozzle assembly relative to the body.

16. A spray gun as defined in claim 15, wherein the stop device comprises a stop element on one of the body and the nozzle assembly, the stop element engaging a groove on the other of the body and the nozzle assembly.

17. A spray gun as defined in claim 13, comprising in addition indicia on the nozzle assembly to indicate the amount of rotation of the nozzle assembly relative to the body.

18. A method of adjusting a fluid spray pattern produced by a spray gun having a nozzle which produces a generally flat spray pattern, which comprises the steps of:

providing the spray gun with a nozzle assembly having the nozzle fixed therein and having a valving mechanism therein to control the flow of fluid, and with the nozzle assembly in a body which permits the nozzle assembly to be rotatably adjusted relative to the body;

mounting the spray gun;

activating the spray gun to produce the spray pattern;

rotating the nozzle assembly relative to the body while the spray gun is activated;

observing the spray pattern while rotating the nozzle assembly; and stopping the rotating when a desired orientation of the spray pattern is observed.

19. The method as defined in claim 18, wherein the nozzle assembly may be selectively secured relative to the body by a locking device, and comprising the additional steps of:

loosening the locking device prior to manually rotating the nozzle assembly; and tightening the locking device after the desired spray pattern is observed.

20. The method as defined in claim 18, repeating the steps of manually rotating the nozzle assembly, observing the spray pattern, and stopping rotating when the spray pattern needs re-adjusting, and performing these steps while the spray gun is activated.

* * * * *